US007519313B2

(12) United States Patent
Jang

(10) Patent No.: US 7,519,313 B2
(45) Date of Patent: Apr. 14, 2009

(54) PAPER JAM REMOVING STRUCTURE FOR IMAGE FORMING APPARATUS

(75) Inventor: Heung-kyu Jang, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 128 days.

(21) Appl. No.: 11/543,254

(22) Filed: Oct. 5, 2006

(65) Prior Publication Data

US 2007/0092294 A1 Apr. 26, 2007

(30) Foreign Application Priority Data

Oct. 10, 2005 (KR) ..... 10-2005-0094916

(51) Int. Cl.
*G03G 15/00* (2006.01)
*G03G 21/00* (2006.01)

(52) U.S. Cl. ..... 399/124; 399/21

(58) Field of Classification Search ..... 399/124, 399/107, 21
See application file for complete search history.

(56) References Cited

U.S. PATENT DOCUMENTS 6,923,584 B2 * 8/2005 Namekawa et al. ..... 400/625
6,978,097 B2 * 12/2005 Ozawa et al. ..... 399/107 X
2005/0265749 A1 * 12/2005 Asanuma et al. ..... 399/124

FOREIGN PATENT DOCUMENTS

| | | |
|---|---|---|
| JP | 2001-197234 | 7/2001 |
| JP | 2003-156897 | 5/2003 |
| JP | 2003-241454 | 8/2003 |
| KR | P1994-67444 | 9/1994 |

OTHER PUBLICATIONS

Machine translation of JP 2003-156897 A dated Apr. 9, 2008.*
Machine translation of JP 2003-241454 A dated Apr. 9, 2008.*

* cited by examiner

*Primary Examiner*—Sophia S Chen
(74) *Attorney, Agent, or Firm*—Roylance, Abrams, Berdo & Goodman, L.L.P.

(57) ABSTRACT

A paper jam removing structure for an image forming apparatus is provided. The image forming apparatus includes at least one roller located in the image forming apparatus on a paper feeding path that feeds paper. A reflection mirror is located such that the roller and the portion around the roller may be seen from the front of the image forming apparatus.

13 Claims, 8 Drawing Sheets

PAPER JAM REMOVING STRUCTURE FOR IMAGE FORMING APPARATUS

CROSS-REFERENCE TO RELATED PATENT APPLICATION

This application claims the benefit under 35 U.S.C. § 119 (a) of Korean Patent Application No. 10-2005-0094916, filed on Oct. 10, 2005, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to a paper jam removing structure that allows a paper jam to be clearly seen and allows easy removal of the jammed paper.

2. Description of the Related Art

Recently, multi-function printers have been widely used for office automation. The multi-function printer is an image forming apparatus having both a printing unit for printing an image onto paper and a scanning unit for extracting an image from a document and converting the image into recordable digital image data.

FIGS. 1 and 2 are a sectional view and a perspective view, respectively, of a multi-function printer as an example of a conventional image forming apparatus.

Referring to FIGS. 1 and 2, a conventional image forming apparatus 10 includes an input panel 16 that is located at the front of a case 11 and has buttons for inputting instructions. A scanning unit 20 is located at the upper portion of the case 11 and has a flat bed 22. A printing unit 30 is located at the lower portion of the case 11 and has a feeding cassette 32. A light scanning unit 37, a developing unit 35, and a fixing unit 40 are disposed within the case 11. A concave portion 25 is located at the border between the scanning unit 20 and the printing unit 30. In the printing unit 30, paper P is picked up from the feeding cassette 32 and transferred along a roughly C-shaped path. An image is formed on one side of the paper P as it passes through the developing unit 35, and the image is fused to the paper P as it passes through the fixing unit 40. The paper P is then fed out by an out-feed roller 45 and loaded on the concave portion 25.

A front door 13 and a rear door 14 are formed in the front and the rear of the case 11, so that components of the printing unit 30 can be fixed and replaced, and jammed paper can be removed. However, when the paper P is jammed between the fixing unit 40 and the out-feed roller 45, a user has to inconveniently move from the front of the image forming apparatus 10, where the input panel is located, to the rear, and open the rear door 14 to remove the paper jam J. When the image forming apparatus 10 is placed near the wall of an office, the user has to inconveniently move the heavy image forming apparatus 10 to remove the paper jam J.

Accordingly, a need exists for an image forming apparatus in which paper jams are easily removed.

SUMMARY OF THE INVENTION

Exemplary embodiments of the present invention provide a paper jam removing structure that allows a paper jam that occurs inside an image forming apparatus to be clearly seen and allows the jammed paper to be removed by reaching from a side of the image forming apparatus.

According to an aspect of the present invention, a paper jam removing structure for an image forming apparatus comprises at least one roller that is located in the image forming apparatus on a paper feeding path and that discharges paper. A reflection mirror is located such that the roller and the portion around the roller may be seen from the front of the image forming apparatus.

The roller may comprise a heat roller and a pressure roller of a fixing unit that fuses an image onto the paper, and an out-feed roller that discharges the paper having the fused image out of the image forming apparatus.

The structure may further comprise a shutter that covers the out-feed roller and the fixing unit when closed, and by which the fixing unit may be reached through the front of the image forming apparatus when the shutter is open. The reflection mirror is located at the inner side of the shutter so that the fixing unit may be seen when the shutter is open.

A guide may be formed at the inner side of the shutter to guide the paper from the fixing unit to the out-feed roller, and the reflection mirror may be located on the surface of the guide.

The shutter may open when pressed from the front of the image forming apparatus towards the rear.

The structure may further comprise a stopper that restricts an opening angle of the shutter.

The image forming apparatus may further comprise a scanning unit that is located at the upper portion and extracts an image from a sheet of a document and converts the image into recordable digital image data. A concave portion is located under the scanning unit and in which the discharged paper is stacked. The shutter is located such that the fixing unit may be reached through the concave portion when the shutter is open.

The roller may comprise a feeding roller that feeds the paper to a developing unit of the image forming apparatus.

The roller may comprise a transfer roller that faces a photoconductive medium of the image forming apparatus and transfers a toner image onto the paper.

The structure may also comprise a front door that allows the jammed paper to be reached through the front of the image forming apparatus when the front door is open.

Other objects, advantages and salient features of the invention will become apparent from the following detailed description, which, taken in conjunction with the annexed drawings, discloses exemplary embodiments of the invention.

BRIEF DESCRIPTION OF THE DRAWINGS

The above and other features and advantages of the present invention will become more apparent by describing in detail exemplary embodiments thereof with reference to the attached drawings, in which.

Throughout the drawings, like reference numerals will be understood to refer to like parts, components and structures.

DETAILED DESCRIPTION OF EXEMPLARY EMBODIMENTS

Hereinafter, exemplary embodiments of a paper jam removing structure for an image forming apparatus of the present invention are described in detail with reference to the accompanying drawings.

Figure 1:
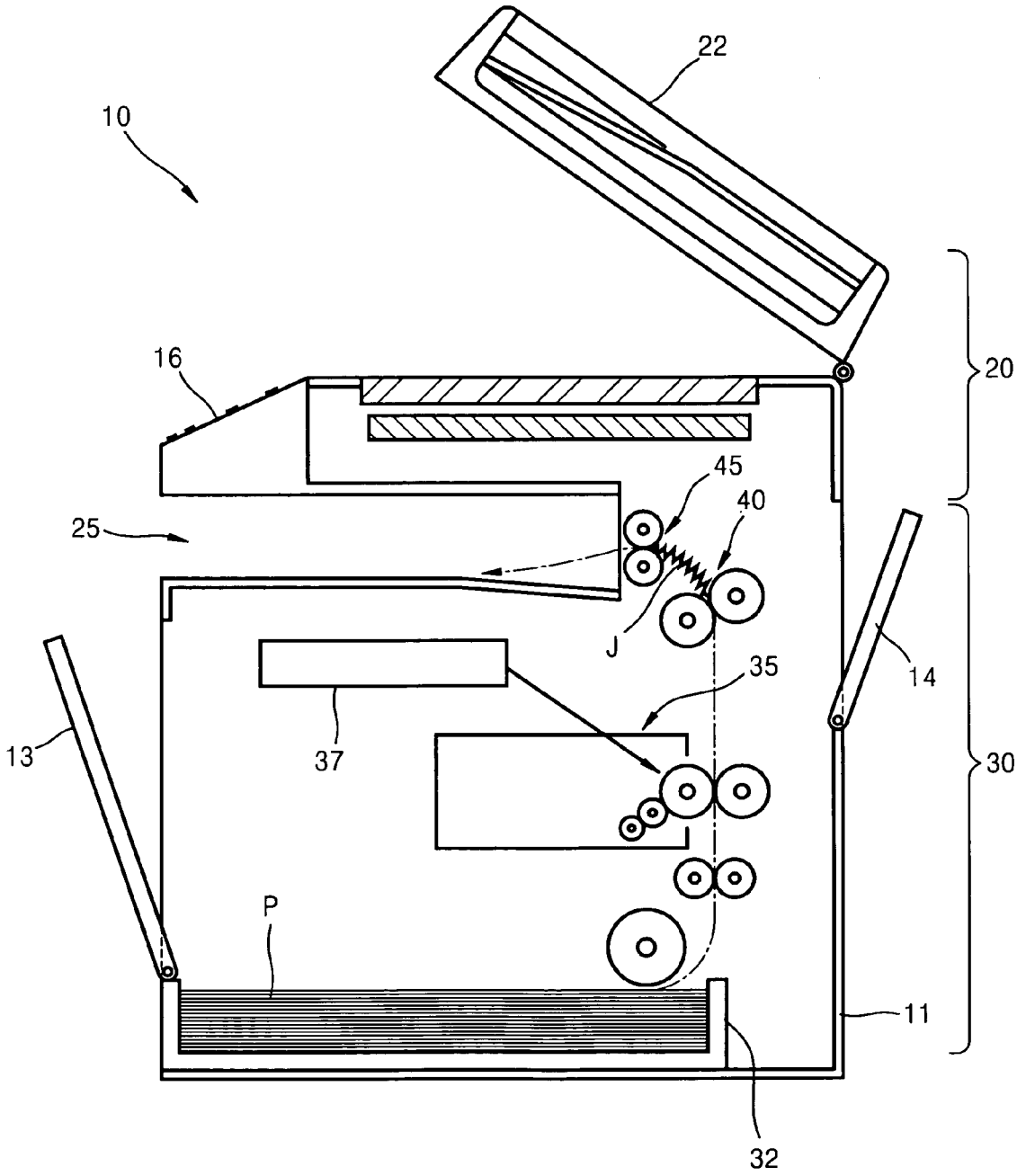
FIG. 1 (PRIOR ART)
FIGS. 1 and 2 are a sectional view and a perspective view of a conventional image forming apparatus.
Figure 2:
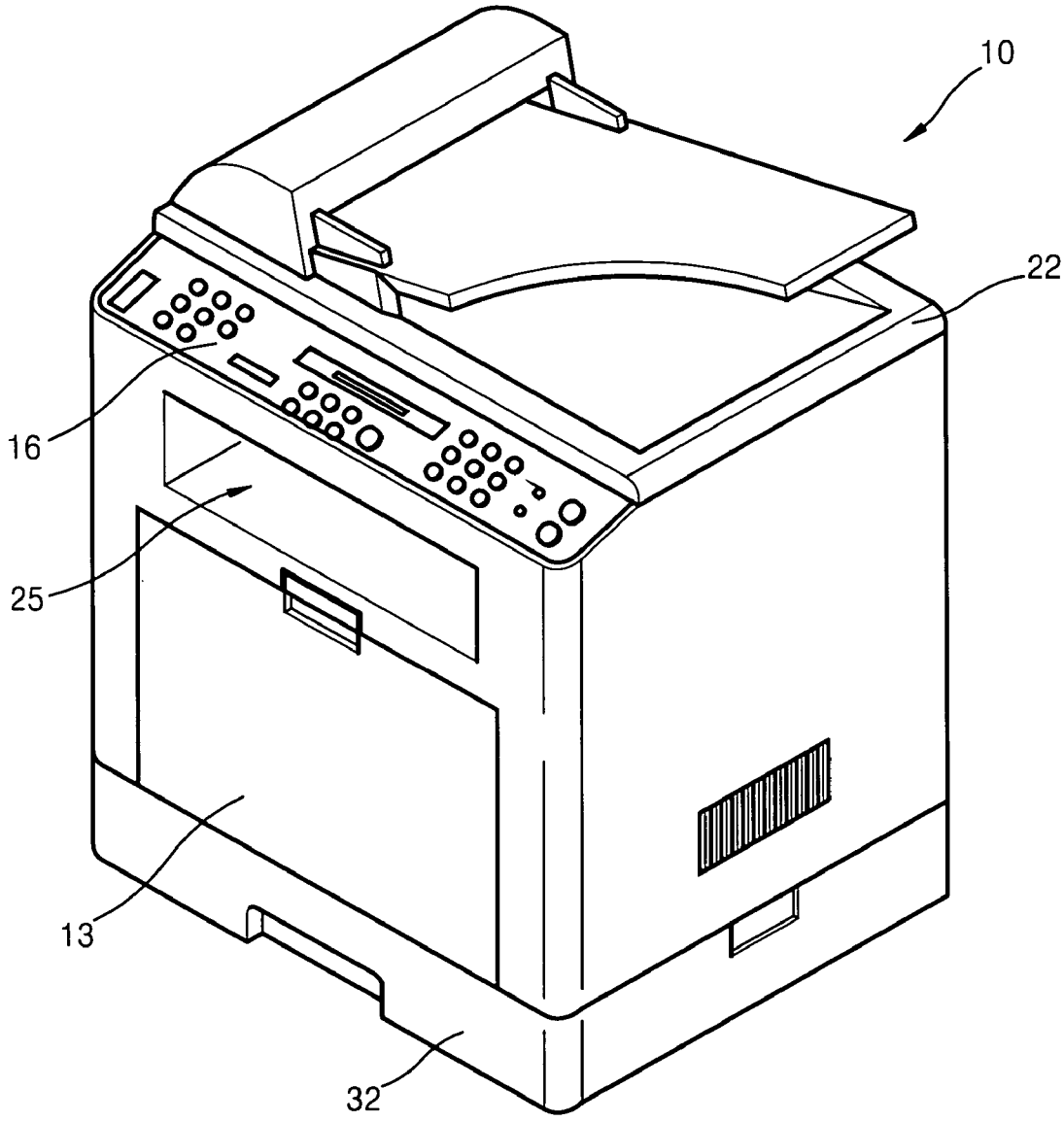
FIG. 2 (PRIOR ART)
Figure 3:
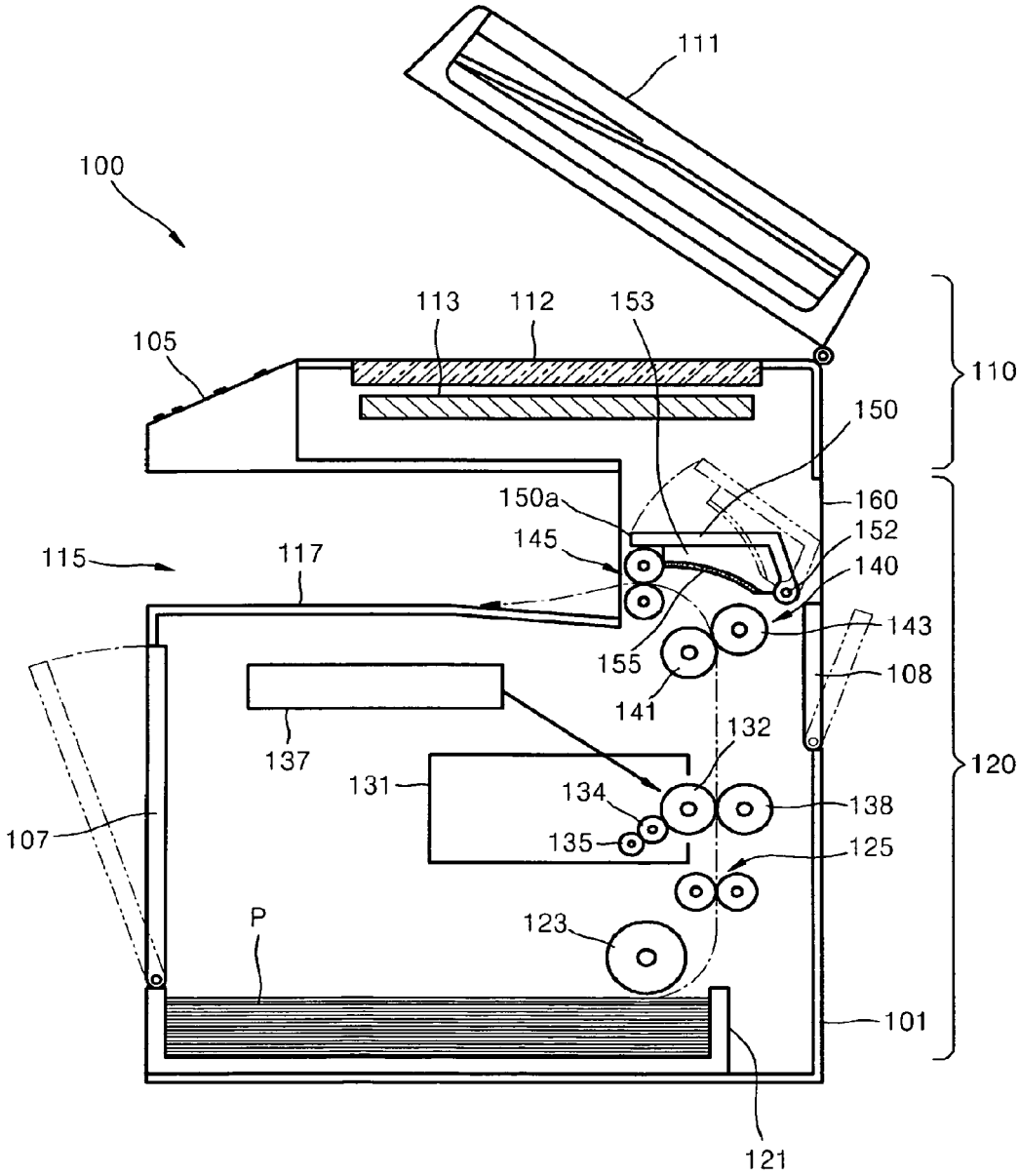
FIG. 3 is an elevational view in partial cross section of an image forming apparatus having a paper jam removing structure according to a first exemplary embodiment of the present invention.
Figure 4:
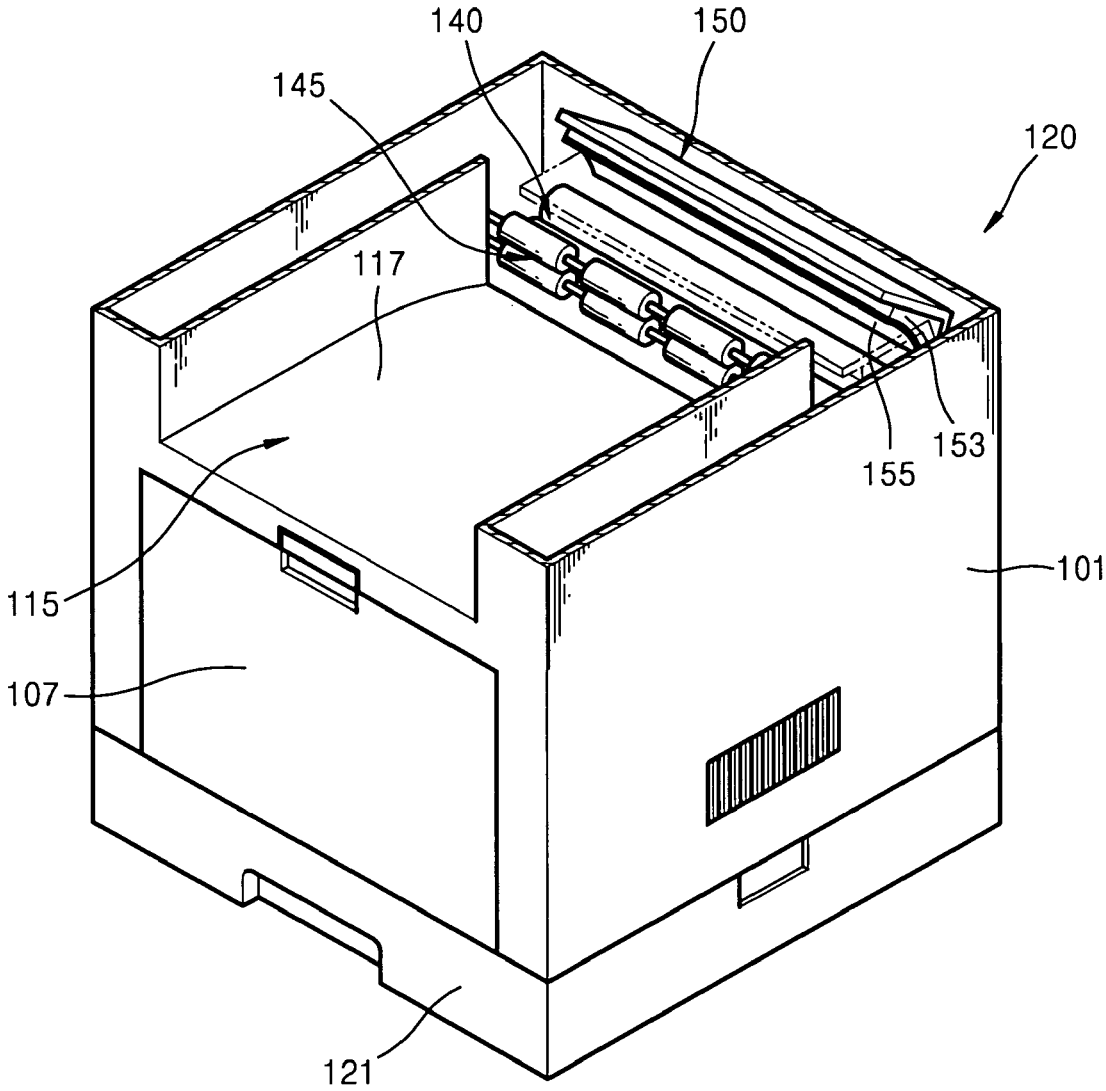
FIG. 4 is a perspective view of the image forming apparatus of FIG. 3 after removing a scanning unit from the upper portion thereof.

FIG. 3 is an elevational view of an image forming apparatus having a paper jam removing structure according to a first exemplary embodiment of the present invention. FIG. 4 is a perspective view of the image forming apparatus of FIG. 3 after removing a scanning unit from the upper portion thereof.

Referring to FIGS. 3 and 4, an image forming apparatus 100 includes an input panel 105 located at the front of a case 101 and having buttons for inputting instructions. A scanning unit 110 is located at the upper portion of the case 101 and extracts an image from a sheet of a document to convert it into a recordable digital image. A concave portion 115 is located under the scanning unit 110 and on which the out-fed paper P having an image formed thereon is loaded. Additionally, a printing unit 120 prints the image onto the paper P is located at the lower portion of the case 101. The concave portion 115 is located at the border between the scanning unit 110 and the printing unit 120.

The scanning unit 110 includes transparent glass 112 on which the document sheet is placed. An image sensor 113 moves in parallel under the transparent glass 112 and extracts the image from the document sheet. A flat bed 111 covers the transparent glass 112 to avoid bad image extraction by preventing leakage of light that is illuminated onto the document sheet by the image sensor 113.

The printing unit 120 prints the image using an electrophotographic method and includes a feeding cassette 121 detachably disposed at the lower portion of the case 101. A developing unit 131 forms the image on one surface of the paper P. A transfer roller 138, a light scanning unit 137, and a fixing unit 140, which fuses the image onto the paper P, are disposed in the case 101.

The developing unit 131 stores toner, which is a developing material, and includes a photoconductive medium 132 on which an electrostatic latent image is formed by scanned light. A developing roller 134 supplies toner onto the electrostatic latent image on the photoconductive medium 132 to develop a visible toner image on the photoconductive medium 132. A supply roller 135 supplies toner to the developing roller 134. Although not shown, the developing unit 131 may also include a charging roller that charges the photoconductive medium 132, a waste toner cleaner that removes remaining toner from the photoconductive medium 132, a doctor blade that controls the thickness of the toner attached to the surface of the developing roller 134, and a agitator that stirs toner stored in the developing unit 131 so that the toner does not harden. The developing unit 131 is replaced when the toner supply is substantially depleted.

The transfer roller 138 contacts the photoconductive medium 132 and presses the paper P onto the photoconductive medium 132 so that the visible toner image is transferred from the photoconductive medium 132 to the paper P. The light scanning unit 137 radiates light corresponding to data of the image to be printed onto the charged photoconductive medium 132 to form the electrostatic latent image. The light scanning unit 137 may use a laser scan unit (LSU) that uses a laser diode light source.

The fixing unit 140 includes a heat roller 141 containing a heating element, such as a halogen lamp (not shown), and a pressure roller 143 facing the heat roller 141. When the paper P having the toner image passes between the heat roller 141 and the pressure roller 143, the toner image is fused onto the paper P by thermal compression using heat and pressure.

The printing unit 120 includes a pick-up roller 123 that picks up the paper P from the feeding cassette 121 sheet by sheet. Additionally, the printing unit 120 includes a feeding roller 125 that feeds the paper P picked up by the pick-up roller 123 towards the developing unit 131 and arranges the paper P before the paper P reaches the photoconductive medium 132 so that the toner image may be transferred onto the desired position. Additionally, the printing unit 120 includes an out-feed roller 145 that feeds the paper P after printing out to an out-feed tray 117 in the concave portion 115.

A front door 107 is provided at the front of the case 101 so that the developing unit 131, the transfer roller 138, and the light scanning unit 137 may be fixed, consumable parts may be replaced, and jammed paper may be removed. Additionally, a rear door 108 is provided at the rear of the case 101 so that the fixing unit 140 may be fixed or replaced.

The printing process of the printing unit 120 having the aforementioned configuration is described hereafter. The photoconductive medium 132 is charged to a predetermined electric potential by the charging roller (not shown), and the electrostatic latent image corresponding to a desired image is formed on the surface of the photoconductive medium 132 in response to light irradiated by the light scanning unit 137. The toner in the developing unit 131 is supplied onto the photoconductive medium 132 on which the electrostatic latent image is formed by the supply roller 135 and the developing roller 134, and the visible toner image is developed onto the photoconductive medium 132. The paper P loaded on the feeding cassette 121 is picked up sheet by sheet by the pick-up roller 123, fed and arranged by the feeding roller 125, and passes between the photoconductive medium 132 and the transfer roller 138. The toner image is transferred from the photoconductive medium 132 onto the surface of the paper P facing the photoconductive medium 132. The toner image is fused onto the paper P by heat and pressure when passing through the fixing unit 140, fed out to the concave portion 115 by an out-feed roller 145, and loaded on the out-feed tray 117.

The image forming apparatus 100 provides a paper jam removing structure in which a paper jam J1 (see FIG. 5) that may occur by the heat roller 141 and the pressure roller 143 of the fixing unit 140, or at the out-feed roller 145, may be easily removed. The paper jam removing structure includes the fixing unit 140, the out-feed roller 145, and a shutter 150 disposed at the inner side of the case 101. The shutter 150 rotates about a hinge 152.

Figure 5:
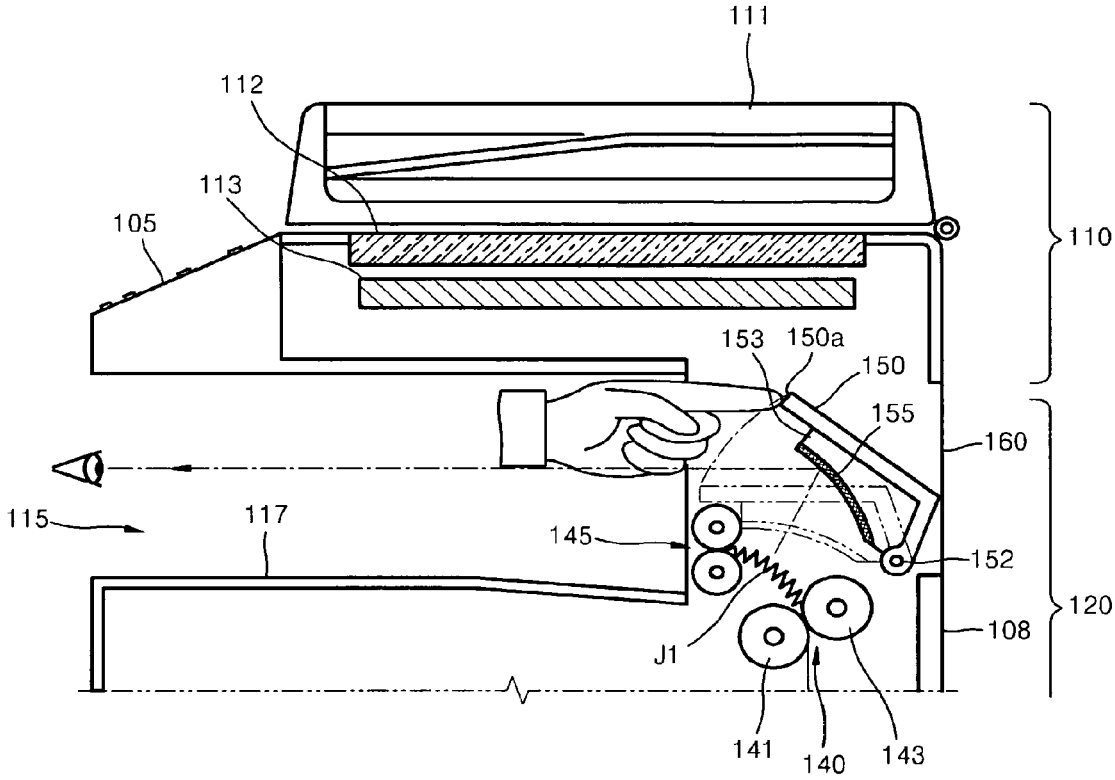
FIG. 5 is an elevational view in partial cross section illustrating a process of removing a paper jam in the image forming apparatus of FIG. 3.

When the shutter 150 is closed, the out-feed roller 145 and the fixing unit 140 are covered. When the shutter 150 is open, a user's hand may reach the fixing unit 140 through the concave portion 115 (FIG. 5). When the shutter 150 is closed, an end portion 150*a* of the shutter 150 is positioned over the out-feed roller 145. When the end portion 150*a* of the shutter 150 is pressed from the front towards the rear, the shutter 150 opens.

A guide 153, which guides the paper P that has passed through the fixing unit 140 to the out-feed roller 145, is formed in the shutter 150. Additionally, a reflection mirror 155 is formed on the surface of the guide 153 so that the fixing unit 140 and a portion (or area) around the fixing unit 140 may be seen from the front through the concave portion 115. The reflection mirror 155 may comprise a mirror attached to the shutter 150, a light reflecting material, such as SiO2, laminated on all or part of the surface of the guide 153, or a light reflection processed film adhered to the guide 153. The reflection mirror 155 may be curved to coincide with the curved portion of the surface of the guide 153, or the reflection mirror may be flat.

When the shutter 150 is opened too far, it is difficult to close because its end portion 150*a* moves too far towards the rear of the image forming apparatus 100. Thus, a stopper 160 that restricts the opening angle of the shutter 150 is located in the image forming apparatus 100. In an exemplary embodiment, an inner wall of the case 101 over the rear door 108 functions as the stopper, but a separate stopper may be used. The shutter 150 may be supported by the stopper 160 to remain in an open position. Preferably, the size and position of the mirror 155 are such that the fixing unit 140 and the portion around the fixing unit 140 may be seen the best when the shutter 150 is in the open position.

FIG. 5 is an elevational view illustrating a process of removing a paper jam in the image forming apparatus of FIG. 3.

Referring to FIG. 5, when the printing unit 120 performs a printing process, the paper P that has passed through the fixing unit 140 may not pass through the out-feed roller 145, thereby causing a paper jam. At this time, a user reaches their hand into the concave portion 115 and pushes the end portion 150*a* of the shutter 150 from the front towards the rear to open the closed shutter 150. The stopper 160 prevents the shutter 150 from opening too far and supports the shutter 150 to hold it open. When the shutter 150 is in the open position, the user may see the paper jam J1 reflected in the reflection mirror 155 from through the concave portion 115. While viewing the paper jam J1, the user may reach over the out-feed roller 145 towards the fixing unit 140 to remove the jammed paper J1. When the jammed paper J1 is removed, the user may close the shutter 150 by reversing the opening procedure and immediately resume printing. Preferably, the concave portion is accessible from the front side of the image forming apparatus, as shown in FIG. 3, although the concave portion may be disposed in any side of the image forming apparatus.

Figure 6:
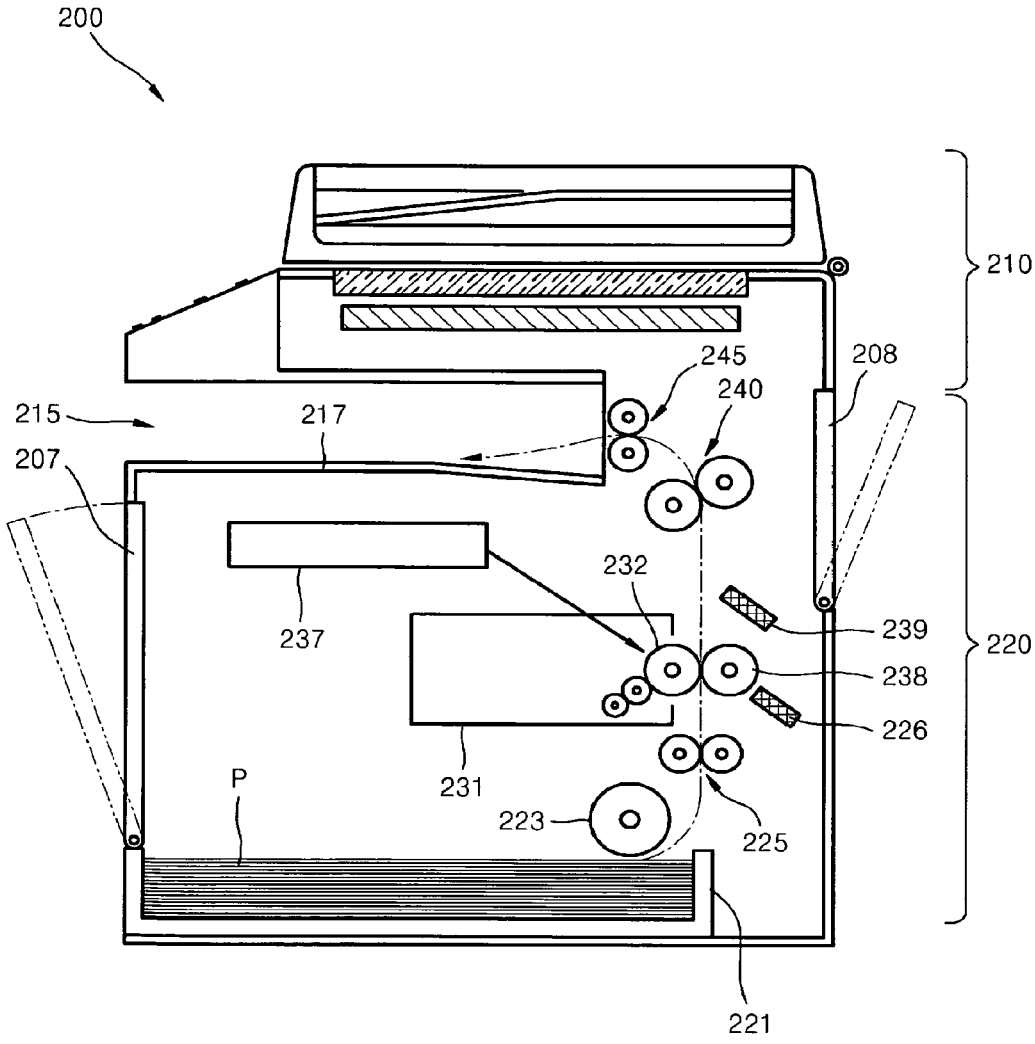
FIG. 6 is an elevational view in partial cross section of an image forming apparatus having a paper jam removing structure according to a second exemplary embodiment of the present invention.
Figure 7:
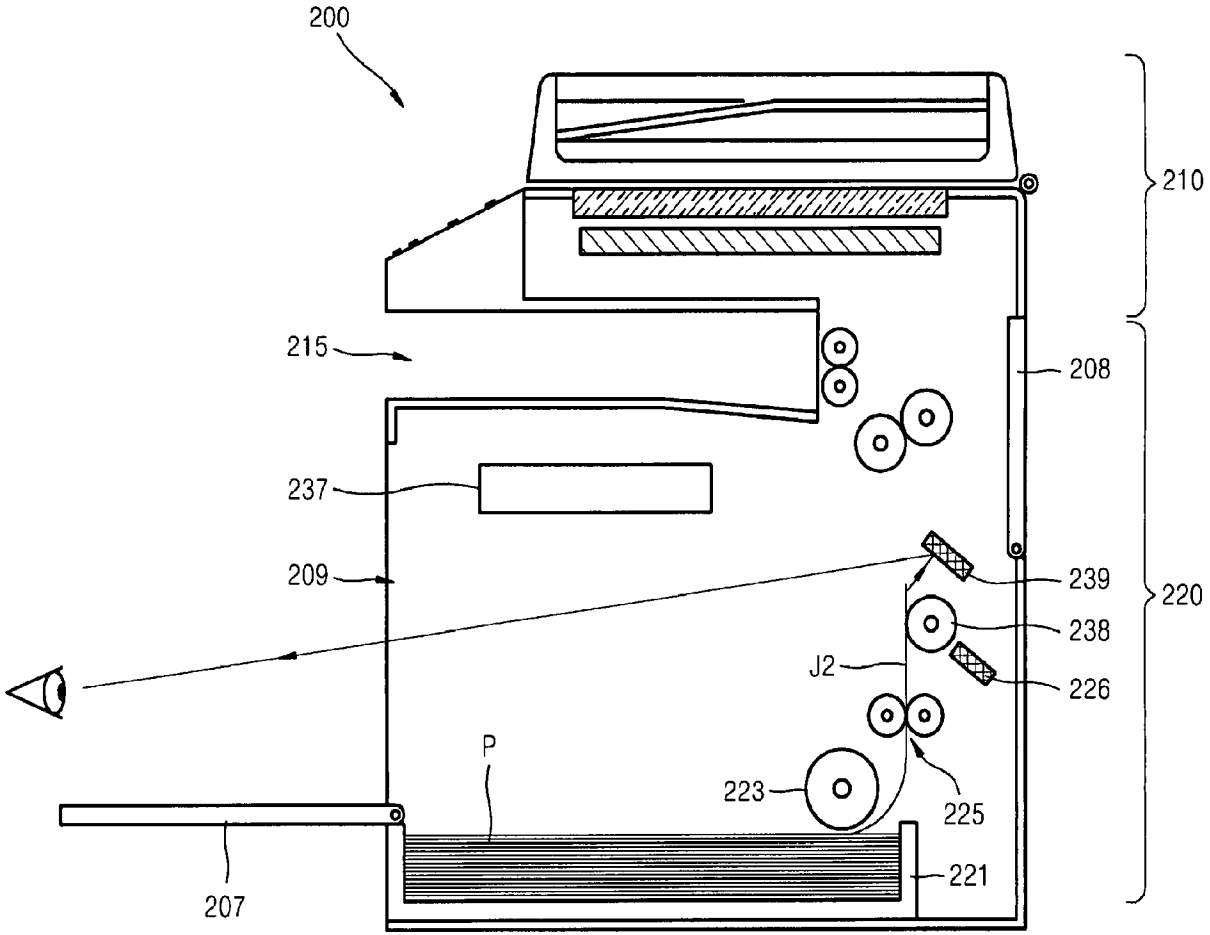
FIG. 7 is an elevational view in partial cross section illustrating a process of removing a paper jam in the image forming apparatus of FIG. 6.

FIG. 6 is an elevational view in partial cross section of an image forming apparatus having a paper jam removing structure according to a second exemplary embodiment of the present invention. FIG. 7 is an elevational view illustrating a process of removing a paper jam in the image forming apparatus of FIG. 6.

Referring to FIG. 6, as shown in the image forming apparatus 100 of FIG. 3, an image forming apparatus 200 is a multi-function printer including a scanning unit 210 at its upper portion, a printing unit 220 at its lower portion, and a concave portion 215 at the border between the scanning unit 210 and the printing unit 220. The printing unit 220 includes a feeding cassette 221 that loads the paper P prior to printing, a developing unit 231 that forms the image on the surface of the paper P, a transfer roller 238, a light scanning unit 237, and a fixing unit 240 that fuses the image onto the paper P.

A photoconductive medium 232, on which the electrostatic latent image is formed by light from the light scanning unit 237, is located proximal the light scanning unit 237. The transfer roller 238 contacts the photoconductive medium 232 and presses the paper P onto the photoconductive medium 232 so that the visible toner image is transferred from the photoconductive medium 232 onto the paper P.

The printing unit 220 includes a pick-up roller 223 that picks up the paper P from the feeding cassette 221 sheet by sheet. Additionally, the printing unit 220 includes a feeding roller 225 that feeds the paper P picked up by the pick-up roller 223 towards the developing unit 231 and arranges the paper P before the paper P reaches the photoconductive medium 232 so that the toner image may be transferred onto the desired position. Additionally, the printing unit 220 includes an out-feed roller 245 that feeds the paper P after printing out to an out-feed tray 217 in the concave portion 215.

A front door 207 is provided at the front of the image forming apparatus 200 so that the developing unit 231, the transfer roller 238, and the light scanning unit 237 may be fixed, consumable parts may be replaced, and jammed paper J2 (see FIG. 7) may be removed. Additionally, a rear door 208 is provided at the rear of the image forming apparatus 200 so that the fixing unit 240 may be fixed or replaced.

The image forming apparatus 200 provides a paper jam removing structure in which a paper jam J2 (see FIG. 7) that may irregularly occur by the feeding roller 225 or the transfer roller 238 may be easily removed. In the paper jam removing structure, the feeding roller 225, the transfer roller 238, the front door 207, a first reflection mirror 226, and a second reflection mirror 239 are provided.

When the front door 207 is open, the jammed paper J2 (see FIG. 7) may be reached through the front of the image forming apparatus 200. The first reflection mirror 226 is located such that the feeding roller 225 and the portion around the feeding roller 225 may be seen from the front through an aperture 209 (see FIG. 7) formed by the open front door 207. Additionally, the second reflection mirror 239 is located such that the transfer roller 238 and the portion around the transfer roller 238 may be seen from the front through the aperture 209 (see FIG. 7) formed by the open front door 207. Although the door 207 is in the front side of the image forming apparatus, the door may be disposed in any side of the image forming apparatus.

Referring to FIG. 7, when the printing unit 220 performs a printing process, the paper P may not entirely pass through the feeding roller 225 or the transfer roller 238, thereby causing a paper jam. At this time, the user opens the front door 207 and takes the developing unit 231 out of the image forming apparatus 200. The user may see the paper jam J2 reflected in the second reflection mirror 239 when looking into the image forming apparatus 200 through the aperture 209 formed in by opening the front door 207. While looking at the paper jam J2, the user may reach inside the image forming apparatus 200 to take out the jammed paper J2. When the jammed paper J2 is removed, the user may close the front door 207 and immediately resume printing. As shown in FIG. 7, when the front end of the jammed paper is located between the feeding roller 225 and the transfer roller 238, the user may clearly see the jammed paper in the first refection mirror 226.

Figure 8:
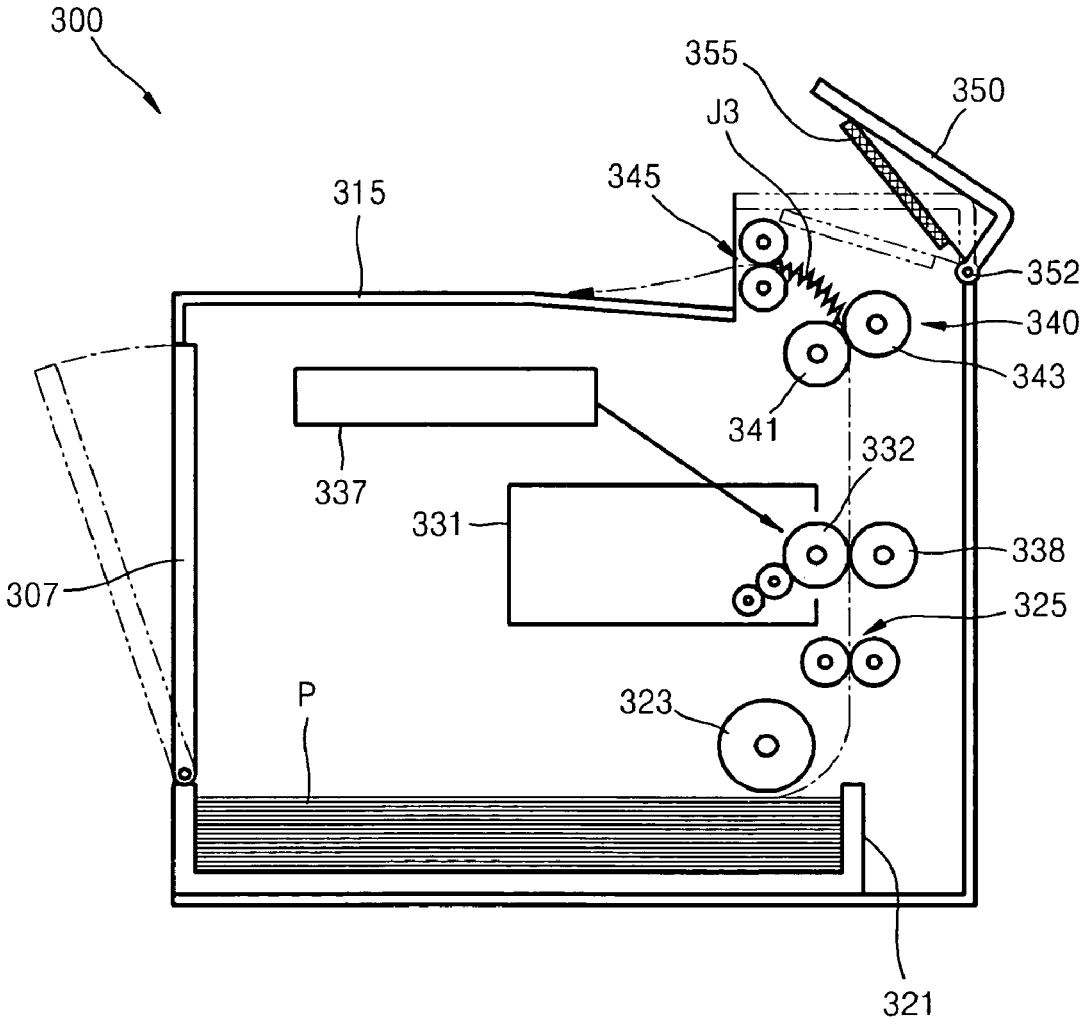
FIG. 8 is an elevational view in partial cross section of an image forming apparatus having a paper jam removing structure according to a third exemplary embodiment of the present invention.

FIG. 8 is an elevational view in partial cross section of an image forming apparatus having a paper jam removing structure according to a third exemplary embodiment of the present invention.

Referring to FIG. 8, an image forming apparatus 300 is an electrophotographic image forming apparatus functioning only to print an image. The image forming apparatus 300 includes a feeding cassette 321 that loads the paper P prior to printing, a developing unit 331 that forms the image on the paper P, a transfer roller 338, a light scanning unit 337, and a fixing unit 340 that fuses the image formed on the paper P onto the paper P.

A photoconductive medium 332, on which the electrostatic latent image is formed by light from the light scanning unit 337, is located in the developing unit 331. The transfer roller 338 contacts the photoconductive medium 332 and presses the paper P onto the photoconductive medium 332 so that the visible toner image is transferred from the photoconductive medium 332 to the paper P.

The image forming apparatus 300 includes a pick-up roller 323 that picks up the paper P from the feeding cassette 321 sheet by sheet. Additionally, the image forming apparatus 300 includes a feeding roller 325 that feeds the paper P picked up by the pick-up roller 323 towards the developing unit 331 and arranges the paper P before the paper P reaches the photoconductive medium 332 so that the toner image may be transferred onto the desired position. Additionally, the image forming apparatus 300 includes an out-feed roller 345 that feeds the paper P after printing out to an out-feed tray 315 placed at the upper side of the image forming apparatus 300. A front door 307 is provided at the front of the image forming apparatus 300 so that the developing unit 331, the transfer roller 338, and the light scanning unit 337 may be fixed, consumable parts may be replaced, and jammed paper may be removed.

The image forming apparatus 300 provides a paper jam removing structure in which a paper jam J3 that may occur by the heat roller 341 and the pressure roller 343 of the fixing unit 340, or the out-feed roller 345 may be easily removed. In the paper jam removing structure, the fixing unit 340, the out-feed roller 345, and a shutter 350 are located at the upper portion of the image forming apparatus 300. The shutter 350 rotates about a hinge 352.

When the shutter 350 is closed, the out-feed roller 345 and the fixing unit 340 are not exposed, whereas when the shutter 350 is open, the user may reach the fixing unit 340 from the front of the image forming apparatus 300. A reflection mirror 355 is located inside the shutter 350 so that a fixing unit 340 and the portion around the fixing unit 340 may be seen from the front of the image forming apparatus 300.

When the image forming apparatus 300 performs a printing process, the paper P that has passed through the fixing unit 340 may not pass through the out-feed roller 345, thereby causing a paper jam. At this time, the user may open the shutter 350 placed at the upper portion of the image forming apparatus 300 and see the paper jam J3 reflected in the reflection mirror 355. While looking at the paper jam J3, the user may reach over the out-feed roller 345 towards the fixing unit 340 to take out the jammed paper J3. When the jammed paper J3 is removed, the user may close the shutter 350 and immediately resume printing.

Accordingly, the paper jam removing structure allows jammed paper to be easily seen and removed from the front of the image forming apparatus, thereby preventing inconvenience in the paper jam removing process.

Also, in the paper jam removing structure according to an exemplary embodiment of the present invention, heat transmission from a fixing unit to a scanning unit may be restricted by a reflection mirror, thereby substantially preventing performance degradation and damage to the scanning unit.

While the present invention has been particularly shown and described with reference to exemplary embodiments thereof, it will be understood by those skilled in the art that various changes in form and detail may be made therein without departing from the spirit and scope of the present invention as defined by the appended claims. For example, not only an electrophotographic image forming apparatus but also an ink jet image forming apparatus may have a paper jam removing structure of the present invention. Therefore, the scope of the invention is defined by the appended claims.

What is claimed is:

1. A paper jam removing structure for an image forming apparatus, comprising:

at least one roller located in the image forming apparatus on a paper feeding path and that feeds paper, the at least one roller comprising a heat roller and a pressure roller of a fixing unit that fuses an image onto the paper and an out-feed roller that discharges the paper having the fused image out of the image forming apparatus;

a shutter that covers the out-feed roller and the fixing unit when closed, and by which the fixing unit is reachable through the front of the image forming apparatus when the shutter is open; and a reflection mirror located such that the at least one roller and the area around the roller are visible from a side of the image forming apparatus, the reflection mirror being located at an inner side of the shutter so that the fixing unit is visible when the shutter is open.

2. The structure according to claim 1, wherein a guide is formed at the inner side of the shutter to guide the paper from the fixing unit to the out-feed roller, and the reflection mirror is located on the surface of the guide.

3. The structure according to claim 1, wherein the shutter opens when pressed from a front side of the image forming apparatus towards a rear side.

4. The structure according to claim 1, further comprising a stopper that restricts an opening angle of the shutter.

5. The structure according to claim 1, the image forming apparatus further comprising a scanning unit that is located at an upper portion of the image forming apparatus and that extracts an image from a sheet of a document and converts the image into recordable digital image data, and a concave portion that is located under the scanning unit and in which the discharged paper is stacked, wherein the shutter is located such that the fixing unit is reachable through the concave portion when the shutter is open.

6. A method of removing a paper jam in an image forming apparatus, comprising the steps of accessing an area in the image forming apparatus proximal at least one roller causing the paper jam, the at least one roller comprising a heat roller and a pressure roller of a fixing unit that fuses an image onto the paper and an out-feed roller that discharges the paper having the fused image out of the image forming apparatus;

moving a shutter covering the at least one roller from a closed to an open position to access the paper jam;

viewing the at least one roller and an area surrounding the at least one roller through a reflection mirror disposed in the image forming apparatus and proximal the at least one roller, the reflection mirror being located at an inner side of the shutter so that the fixing unit is visible when the shutter is open; and removing the jammed paper from the image forming apparatus.

7. A method of removing a paper jam in an image forming apparatus according to claim 6, further comprising closing the shutter to cover the at least one roller.

8. A method of removing a paper jam in an image forming apparatus according to claim 6, further comprising accessing the area in the image forming apparatus through a door in a case of the image forming apparatus.

9. A method of removing a paper jam in an image forming apparatus according to claim 6, further comprising accessing the area in the image forming apparatus through a concave portion in a case of the image forming apparatus.

10. A method of removing a paper jam in an image forming apparatus according to claim 9, wherein the concave portion is disposed between a scanning unit and a printing unit.

11. A method of removing a paper jam in an image forming apparatus according to claim 10, further comprising moving a shutter covering the at least one roller from a closed to an open position to access the paper jam.

12. A method of removing a paper jam in an image forming apparatus according to claim 11, wherein the shutter substantially prevents heat generated by the printing unit from reaching the scanning unit.

13. A method of removing a paper jam in an image forming apparatus according to claim 6, wherein the reflection mirror is connected to the shutter.

* * * * *